US010465473B2

(12) United States Patent
Meling et al.

(10) Patent No.: US 10,465,473 B2
(45) Date of Patent: Nov. 5, 2019

(54) ANNULAR SAFETY VALVE PULL THROUGH DEVICE

(71) Applicant: Schlumberger Technology Corporation, Sugar Land, TX (US)

(72) Inventors: Geir Meling, Stavanger (NO); Joseph Daniel Filbrandt, Stavanger (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/043,097

(22) Filed: Feb. 12, 2016

(65) Prior Publication Data

US 2016/0237780 A1 Aug. 18, 2016

Related U.S. Application Data

(60) Provisional application No. 62/115,980, filed on Feb. 13, 2015.

(51) Int. Cl.

| | |
|---|---|
| ***E21B 34/06*** | (2006.01) |
| ***E21B 34/10*** | (2006.01) |
| ***E21B 17/02*** | (2006.01) |

(52) U.S. Cl.

CPC ..... *E21B 34/06* (2013.01); *E21B 17/028* (2013.01); *E21B 34/105* (2013.01)

(58) Field of Classification Search

CPC ..... E21B 34/06; E21B 34/105

See application file for complete search history.

(56) References Cited

U.S. PATENT DOCUMENTS

| | | | | |
|---|---|---|---|---|
| 3,835,929 | A * | 9/1974 | Suman, Jr. | E21B 17/003 166/384 |
| 4,199,854 | A * | 4/1980 | Bitting | H01B 13/0003 29/426.5 |
| 4,621,689 | A | 11/1986 | Brookbank, III | |
| 5,070,940 | A * | 12/1991 | Conner | E21B 17/023 166/105 |
| 6,082,452 | A * | 7/2000 | Shaw | B04C 5/00 166/105.5 |
| 6,323,420 | B1 * | 11/2001 | Head | F16L 7/00 138/103 |
| 6,341,652 | B1 * | 1/2002 | Malone | E21B 17/206 166/133 |
| 6,582,145 | B1 * | 6/2003 | Malone | E21B 17/206 166/242.1 |
| 6,727,828 | B1 | 4/2004 | Malone et al. | |

(Continued)

FOREIGN PATENT DOCUMENTS

| | | | |
|---|---|---|---|
| WO | WO2006034214 | A2 | 3/2006 |
| WO | WO2012166418 | A2 | 12/2012 |

OTHER PUBLICATIONS

Extended European Search Report issued in European Patent Application 16155487.8 dated Aug. 17, 2016. 9 pages.

*Primary Examiner* — Matthew R Buck
*Assistant Examiner* — Aaron L Lembo

(57) ABSTRACT

A safety valve with a pre-installed penetration member is disclosed. The penetration member is installed into the safety valve before installing the safety valve in the well. The penetration member is coupled to a cable which communicates with a downhole component, such as a gauge. Pulling the penetration member upward pulls the cable upward through the safety valve.

20 Claims, 4 Drawing Sheets

(56) References Cited

U.S. PATENT DOCUMENTS

| | | | | |
|---|---|---|---|---|
| 7,987,914 | B2 * | 8/2011 | Benton | E21B 23/04 166/332.1 |
| 2008/0314616 | A1 * | 12/2008 | Benestad | H01B 17/30 174/152 R |
| 2011/0120696 | A1 * | 5/2011 | Denny | E21B 33/03 166/65.1 |
| 2013/0309888 | A1 * | 11/2013 | Nicholson | E21B 17/025 439/271 |

* cited by examiner

ANNULAR SAFETY VALVE PULL THROUGH DEVICE

CROSS REFERENCE TO EARLIER APPLICATIONS

This application claims the benefit of U.S. Provisional Patent Application No. 62/115,980 entitled "Annular Safety Valve Pull Through Device" filed Feb. 13, 2015 which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. One piece of equipment which may be installed is an annular safety valve, which provides the ability to protect, or stop hydrocarbon flow through an annulus of the well completion.

SUMMARY

Embodiments of the present disclosure are directed to a safety valve including a valve member configured to selectively close a well to prevent unwanted production from the well. The valve member has a feed through portion. The safety valve assembly also includes a penetration member positioned in the feed through member with a down-hole end protruding from the feed through member. The down-hole end of penetration member is configured to be coupled to a cable in the well. The penetration member is configured to be pulled upward through the feed through member of the safety valve with the cable attached, such that the cable will be pulled through the feed through member.

In other embodiments, the present disclosure is directed to a method of installing a safety valve in a well. The method includes providing a safety valve having a valve component configured to selectively seal the well and a feed through portion. The method also includes installing a penetration member in the safety valve in the feed through portion with a portion of the penetration member extending in a down-hole direction from the feed through portion. As the safety valve is installed at a surface of the well, the method includes coupling the penetration member to a cable in the well below the safety valve, and pulling upward on the penetration member to pull the cable through the feed through member.

In still further embodiments the present disclosure is directed to a method of installing a safety valve in a well including installing a lower completion component in the well. The lower completion includes at least one component coupled to a cable. The cable communicates between the lower completion and a surface. The method also includes installing a safety valve onto the lower completion. The safety valve includes a selectively closable valve and a feed through portion, wherein the feed through portion is configured to receive the cable. The method also includes installing a penetration member in the safety valve with a portion of the penetration member protruding from the feed through portion, coupling a portion of the penetration member to the cable, and pulling the penetration upward through the feed through portion such that the cable is pulled upward through the feed through member.

In some embodiments, a permanent downhole cable (PDC) is to be run through an Annular Safety Valve, the PDC must be pushed through the ASV. Sometimes a guide is provided. However, tension cannot be applied to assist in feeding the cable through the bypass in the ASV. As a result, the operation is not always successful. Embodiments of this disclosure provide a means to pull with tension on the cable.

Figure 1:
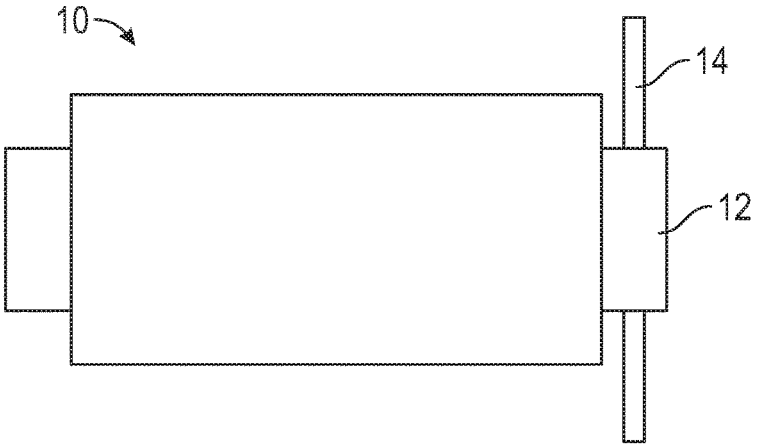
FIG. 1 illustrates a safety valve according to embodiments of the present disclosure.

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of this disclosure.

DETAILED DESCRIPTION

In the following description, numerous details are set forth to provide an understanding of the present invention. However, it will be understood by those skilled in the art that the present system and/or methodology may be practiced without these details and that numerous variations or modifications from the described embodiments may be possible.

FIG. 1 illustrates a safety valve 10 according to embodiments of the present disclosure. The safety valve 10 includes a feed through portion 12 which serves to anchor the safety valve 10 in a well. The safety valve 10 can be a fail-safe valve which is positioned in a well to seal off production flow in the event of a failure. These valves are held in an open position by an energy source, such as a nitrogen chamber or a spring and, when failure occurs, this energy source fails as well, causing the safety valve 10 to close. The feed through member 12 is configured to secure the safety valve 10 in the well and to permit certain components to pass through the safety valve without interrupting the operation of the safety valve 10. The safety valve 10 and the feed through member 12 are depicted here in conceptual form. Details of the operation of the safety valve 10 and feed through member 12 are not shown. The assembly also includes a penetration member 14. The penetration member 14 is installed in the feed through member 12 before the safety valve 10 is installed in the well. The penetration member 14 can be a steel bar of appropriate dimensions. In some embodiments the penetration member 14 can be approximately two meters long and 5 millimeters thick. These dimensions may vary according to the size of the safety valve 10 and the completion into which the assembly is installed. The penetration member 14 is configured to be attached to a cable (shown in FIG. 2) below the safety valve 10 and facilitates pulling the cable upward through the safety valve 10 without excessive strain on the cable.

Figure 2:
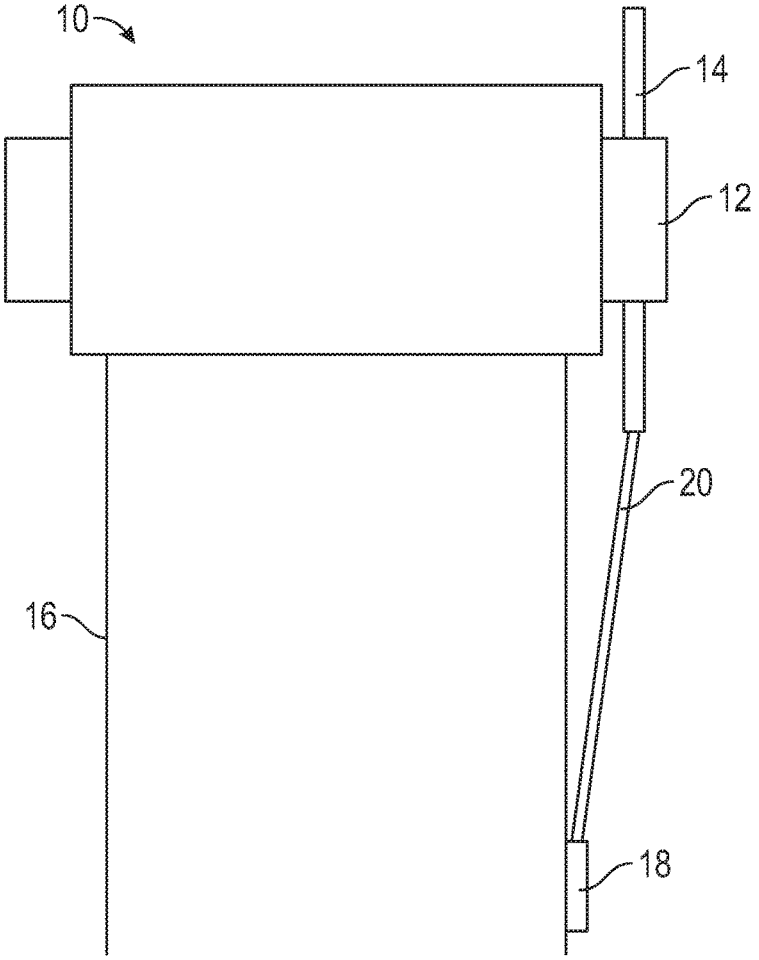
FIG. 2 shows the safety valve of FIG. 1 attached to a cable and a completion according to embodiments of the present disclosure.
Figure 3:
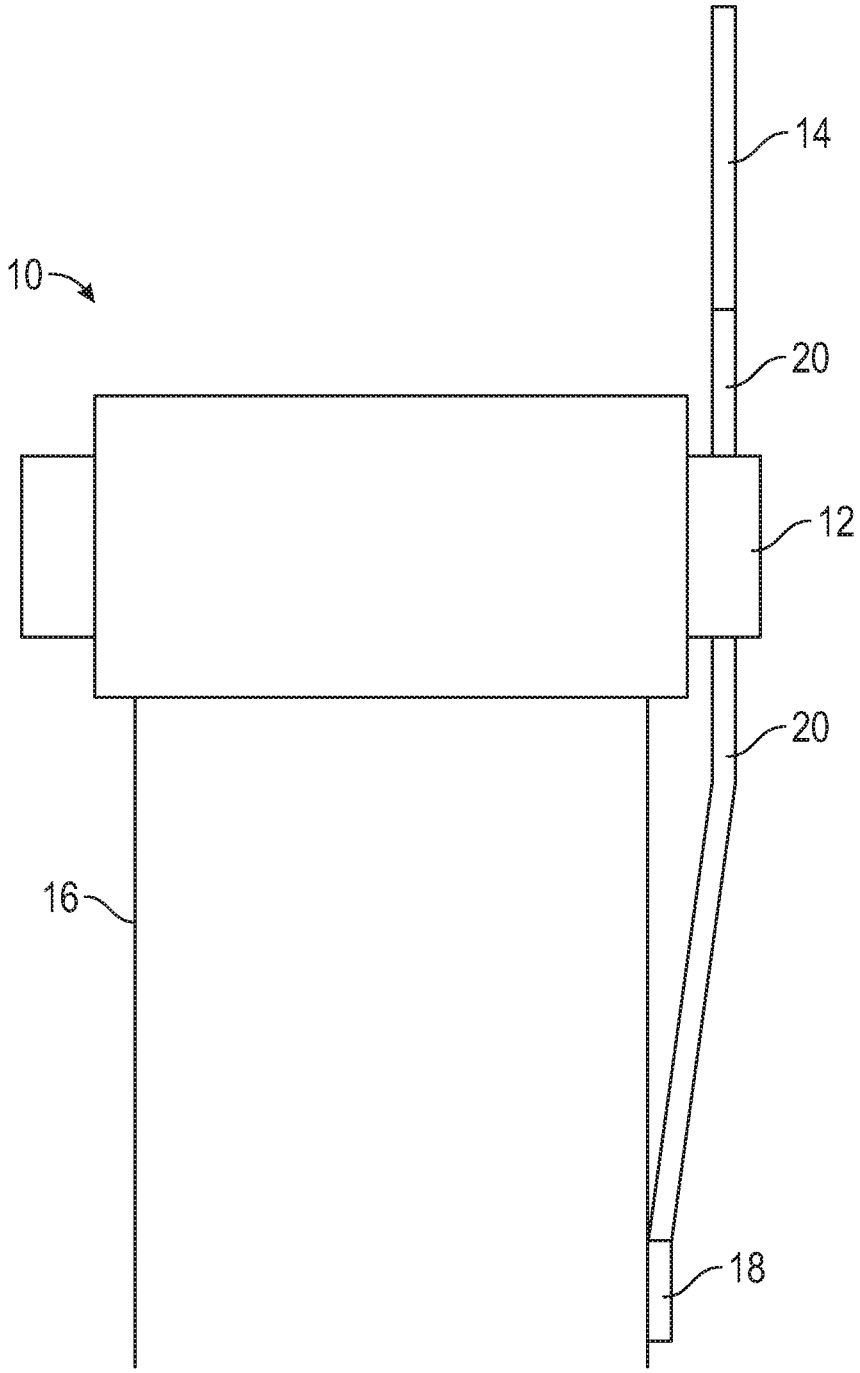
FIG. 3 shows the assembly in position after installation and after the penetration member has been pulled upward through the feed through portion.

FIG. 2 shows the safety valve 10 of FIG. 1 attached to a cable and a completion according to embodiments of the present disclosure. The safety valve 10 is installed initially at the wellhead where it is connected to the existing completion 16. Part of the completion 16 is a gauge 18 (or another component) which has a cable 20 extending upward from the gauge 18. As the safety valve 10 is installed, the penetration member 14 and the cable 20 are connected, such that pulling the penetration member 14 upward and out of the feed through member 12 will pull the cable upward and through as well. The penetration member 14 is better suited to the high stresses associated with making this pull. Once the safety valve 10 is installed and the penetration member 14 is coupled to the cable 20, the safety valve 10 and the remainder of the completion can be lowered into position in the well as more completion components can be installed above the safety valve 10. FIG. 3 shows the assembly in position after installation and after the penetration member 14 has been pulled upward through the feed through portion 12.

Figure 4:
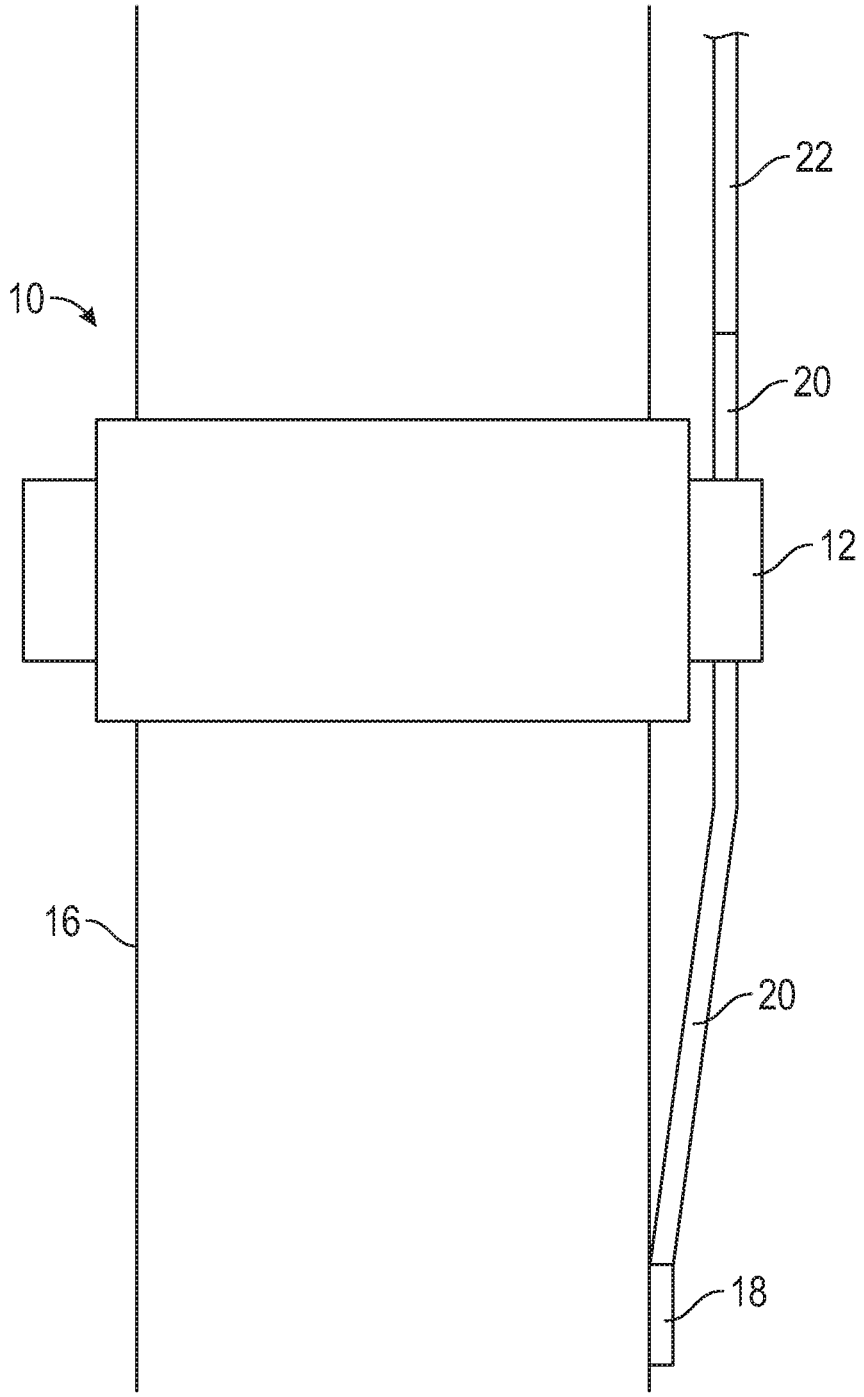
FIG. 4 depicts the assembly of FIGS. 1-3 according to embodiments of the present disclosure.

FIG. 4 depicts the assembly of FIGS. 1-3 according to embodiments of the present disclosure. After pulling the penetration member and attached cable 20 upward and through the safety valve 10, the penetration member is removed and the cable is spliced with an upward section 22 of the cable 20 to preserve the electrical operability of the cable 20.

Figure 5:
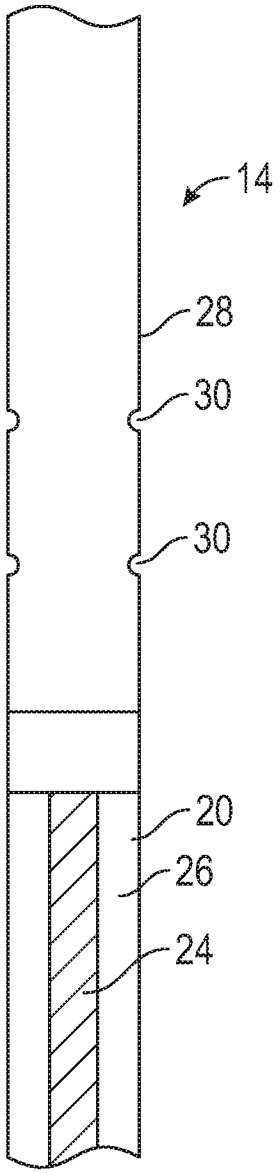
FIG. 5 shows the penetration member according to embodiments of the present disclosure.

FIG. 5 shows the penetration member 14 according to embodiments of the present disclosure. The penetration member 14 can be made of steel or another suitable material strong enough to withstand the tensile forces applied while being pulled upward through a feed through member of a safety valve with a cable 20 attached. The cable 20 is attached to a lower portion of the penetration member 14. The cable 20 can be modified to accommodate the penetration member 14. The cable 20 can include an electrical component 24 and an insulating component 26, portions of which can be removed to accommodate the penetration member 14. The cable 20 can be fit around the penetration member 14 and then crimped to the penetration member 14. In embodiments, this operation can be performed using pliers or another suitable crimping tool to couple the cable 20 to the penetration member 14. An outer surface 28 of the penetration member 14 can be formed with notches 30 which further strengthens the coupling between the cable 20 and the penetration member 14. The cable 20 can be shaped to fit within the notches 30 to further strengthen the coupling.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In some embodiments, the penetration member 14 is a 5 millimeter steel bar and the cable 20 is a ¼" permanent downhole cable. In some embodiments, the penetration member 14 is machined to be able to enter into the ¼" cable. Once the ¼" cable is deformed, it provides sufficient pulling power for the operation.

In some embodiments the 5 mm steel bar may be machined to a narrower diameter or to have a particular shape to provide more strength to the coupling. The penetration member 14 and cable 20 coupling can withstand 200 kg force before the penetration member 14 detaches from the cable 20. This force may be increased by placing more deformations on the PDC line, and a more precise deformation. All of these can be fine-tuned to insure repeatability.

One advantage of the presently disclosed system is that the safety valve can be built with the penetration member in the valve before installing the safety valve. This minimizes rig time because the operators simply attach the cable to the penetration member as the safety valve is installed, and when the time comes, the operator pulls on the penetration member to thread the cable through the safety valve. The penetration member and cable are analogous to a needle and thread. Once the cable is through, the penetration member is removed and discarded and the safety valve is operational.

While a limited number of embodiments been described, those skilled in the art, having the benefit of this disclosure, will appreciate numerous modifications and variations there from. It is intended that the appended claims cover all such modifications and variations.

What is claimed is:

1. A system, comprising:

a cable; and a safety valve, the safety valve comprising:

a valve member configured to selectively close a well to prevent unwanted production from the well, the valve member having a feed through member;

a penetration member installed in the feed through member with a down-hole end of the penetration member protruding from the feed through member, wherein the down-hole end of the penetration member is coupled to the cable in the well;

wherein the penetration member is made of steel or another material configured to withstand tensile forces while being pulled upward and out of the feed through member of the safety valve with the cable attached, such that the cable will be pulled through the feed through member.

2. The system of claim 1 wherein the penetration member is a steel bar.

3. The system of claim 1 wherein the penetration member and cable are formed with corresponding deformations to strengthen a coupling between the penetration member and the cable.

4. The system of claim 1 wherein the valve member is an annular safety valve and the cable is a permanent downhole cable.

5. The system of claim 1 where the penetration member is longer than the feed through member such that the penetration member extends beyond the feed through member above and below the feed through member.

6. The system of claim 1 wherein the penetration member is approximately two meters long.

7. The system of claim 1 wherein the penetration member is approximately five millimeters thick.

8. The system of claim 1, further comprising a downhole gauge operably coupled to the cable.

9. The system of claim 1 wherein the penetration member is configured to be removed and discarded from the safety valve after pulling through the cable.

10. The system of claim 1 wherein a coupling between the cable and penetration member can withstand at least 200 kg of force without detaching.

11. The system of claim 1 wherein the penetration member has notches on an exterior surface, wherein the notches are configured to engage with the cable.

12. A method of installing a safety valve in a well, comprising:

providing a safety valve having a valve component configured to selectively seal the well, and a feed through member;

installing a penetration member in the safety valve in the feed through member with a portion of the penetration member extending in a downhole direction from the feed through member;

as the safety valve is installed at a surface of the well, coupling the penetration member to a cable in the well below the safety valve; and pulling upward on the penetration member such that the penetration member is pulled out of the feed through member to pull the cable through the feed through member, wherein the penetration member is made of steel or another material configured to withstand tensile forces while being pulled upward and out of the feed through member.

13. The method of claim 12, further comprising removing the penetration member.

14. The method of claim 12, further comprising shaping a portion of the penetration member to fit within a portion of the cable.

15. The method of claim 12, further comprising removing a portion of the cable to accommodate a portion of the penetration member within the cable.

16. The method of claim 12, further comprising coupling the cable to a gauge in the well below the safety valve.

17. A method of installing a safety valve in a well, comprising:

installing a lower completion component in the well, wherein the lower completion includes at least one component coupled to a cable, wherein the cable communicates between the lower completion and a surface;

installing a safety valve onto the lower completion, wherein the safety valve includes a selectively closable valve and a feed through member, wherein the feed through member is configured to receive the cable;

installing a penetration member in the safety valve with a portion of the penetration member protruding from the feed through member;

coupling a portion of the penetration member to the cable; and pulling the penetration member upward and out of the feed through member such that the cable is pulled upward through the feed through member, wherein the penetration member is made of steel or another material configured to withstand tensile forces while being pulled upward and out of the feed through member.

18. The method of claim 17, further comprising crimping the cable to the penetration member.

19. The method of claim 17, further comprising removing the penetration member from the cable once the cable is pulled through the feed through portion.

20. The method of claim 17, wherein installing the penetration member comprises inserting a steel bar into the feed through at the surface of the well.

* * * * *